US008851646B2

(12) United States Patent
Kodama et al.

(10) Patent No.: US 8,851,646 B2
(45) Date of Patent: Oct. 7, 2014

(54) CARTRIDGE

(71) Applicant: Seiko Epson Corporation, Tokyo (JP)

(72) Inventors: Hidetoshi Kodama, Nagano (JP); Izumi Nozawa, Nagano (JP); Tadahiro Mizutani, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/899,735

(22) Filed: May 22, 2013

(65) Prior Publication Data

US 2013/0314476 A1 Nov. 28, 2013

(30) Foreign Application Priority Data

May 23, 2012 (JP) ..... 2012-117254

(51) Int. Cl.
*B41J 2/175* (2006.01)
*B41J 29/393* (2006.01)

(52) U.S. Cl.
CPC ..... *B41J 2/17566* (2013.01); *B41J 2/17513* (2013.01)
USPC ..... 347/86; 347/19

(58) Field of Classification Search
USPC ..... 347/7, 19, 84, 85, 86, 87
See application file for complete search history.

(56) References Cited

U.S. PATENT DOCUMENTS

| | | | | |
|---|---|---|---|---|
| 6,213,598 | B1 * | 4/2001 | Hou et al. | 347/86 |
| 6,773,099 | B2 * | 8/2004 | Inoue et al. | 347/86 |
| 6,848,776 | B2 | 2/2005 | Nishioka et al. | |
| 6,921,161 | B2 * | 7/2005 | Morita et al. | 347/86 |
| 7,293,850 | B2 | 11/2007 | Yamamoto | |
| 7,726,793 | B2 | 6/2010 | Yamamoto | |
| 2003/0174181 | A1 | 9/2003 | Nishioka et al. | |
| 2005/0270347 | A1 | 12/2005 | Yamamoto | |
| 2008/0012885 | A1 | 1/2008 | Yamamoto | |

FOREIGN PATENT DOCUMENTS

| | | | |
|---|---|---|---|
| JP | 2003-237096 | A | 8/2003 |
| JP | 2004-017599 | A | 1/2004 |
| JP | 2005-342992 | A | 12/2005 |
| JP | 2006-001272 | A | 1/2006 |

* cited by examiner

*Primary Examiner* — Anh T. N. Vo
(74) *Attorney, Agent, or Firm* — Global IP Counselors, LLP

(57) ABSTRACT

The object of the invention is to provide a cartridge in which the remaining amount of liquid in a liquid chamber can be accurately detected. The air introducing port is provided in a position closer to an upper end of the largest outer surface in a vertical direction and in a position closer to a left end of the largest outer surface relative in a horizontal direction. The liquid detecting section is provided in a position closer to a lower end of the largest outer surface in the vertical direction and in a position closer to a right end of the largest outer surface in the horizontal direction.

11 Claims, 7 Drawing Sheets

CARTRIDGE

CROSS-REFERENCE TO RELATED APPLICATIONS

This application claims priority to Japanese Patent Application No. 2012-117254 filed on May 23, 2012. The entire disclosure of Japanese Patent Application No. 2012-117254 is hereby incorporated herein by reference.

BACKGROUND

1. Technical Field

The present invention relates to a cartridge that stores liquid such as ink or the like.

2. Related Art

As a cartridge that can be attached to and removed from a printing device, there is a cartridge that includes a liquid chamber that stores liquid such as ink or the like, a liquid supply port that supplies liquid to the printing device, an air introducing section that introduces air from the outside to the liquid chamber in accordance with supply of liquid to the printing device, a liquid detecting section that optically detects the remaining amount of liquid in the liquid chamber, and the like. In such a cartridge, the remaining amount of liquid in the liquid chamber needs to be detected accurately by the liquid detecting section, and in particular, false detection caused by air bubbles in the ink due to introduction of the air needs to be reduced.

Thus, as a configuration of a cartridge for accurately detecting the remaining amount of liquid, for example, a configuration has been known in which a partition wall is provided in a region between the air introducing section and the liquid detecting section so as to capture air bubbles by the partition wall, and air bubbles generated due to introduction of the air can be prevented from entering a partition on the liquid detecting section side (for example, Patent Document 1). Also, a configuration has been known in which a filter is provided in the vicinity of a liquid detecting section, with the filter being made of a porous material through which liquid and air bubbles can pass, and small air bubbles passing through the filter gather so as to form large air bubbles (for example, Patent Document 2). Further, a configuration has been known in which an ink flow passage is provided in the vicinity of a liquid detecting section, and air bubbles are pressed and collapsed in the ink flow passage so as to form larger air bubbles (for example, Patent Document 3).

Japanese Laid-open Patent Publication No. 2005-342992 (Patent Document 1), Japanese Laid-open Patent Publication No. 2004-17599 (Patent Document 2) and Japanese Laid-open Patent Publication No. 2003-237096 (Patent Document 3) are examples of the related art.

SUMMARY

In the cartridge described in Patent Document 1, however, air bubbles cannot be completely prevented from entering a partition in which the liquid detecting section is provided because the partition in which the liquid detecting section is provided connects to a partition in which air bubbles are captured through an opening. In particular, there are cases in which vibration is applied to the cartridge when the cartridge installed in a carriage of a printing device moves back and forth or external vibration is applied to the printing device. In such cases, it is very likely that air bubbles will enter the partition in which the liquid detecting section is provided through the opening or air bubbles will be generated due to air mingled with the ink in this partition. Then, there is fear that small air bubbles adhere to the liquid detecting section, resulting in false detection. Also, in the cartridge described in Patent Document 2 and Patent Document 3, the detection accuracy of the liquid detecting section can be improved by causing small air bubbles to be united with each other so as to form large air bubbles. However, in a case of supplying ink at high speed corresponding to increase in the printing speed of recent years, the amount of supplying ink per unit time is increased, and thus time for forming large air bubbles cannot be secured. Therefore, since the remaining amount is detected in a state where small air bubbles adhere to the liquid detecting section, there is a problem that the remaining amount cannot be accurately detected.

The invention has been made to address the above-described circumstances at least partly, and can be implemented as following aspects or application examples.

APPLICATION EXAMPLE 1

According to this application example, a cartridge for storing liquid to be supplied to a printing device includes a liquid chamber formed with an inner wall of a reservoir main body member and a flexible sheet member attached to the reservoir main body member, a pressure receiving plate provided in the liquid chamber such that the surface thereof contacts the sheet member, a first biasing member biasing the pressure receiving plate in a direction for enlarging an inner space of the liquid chamber, a liquid supply port supplying liquid stored in the liquid chamber to the printing device, an air introducing port introducing outer air to the inside of the liquid chamber, a valve mechanism including a valve body and a second biasing member biasing the valve body in a direction for closing the air introducing port, the valve mechanism adjusting introduction of air to the liquid chamber by opening or closing the air introducing port, and a liquid detecting section provided inside the liquid chamber to optically detect liquid. When the cartridge is viewed in a direction perpendicular to a largest outer surface whose area is the largest among a plurality of outer surfaces of the cartridge in a state in which the cartridge is installed in the printing device, the inner air introducing port is provided in a position closer to an upper end of the largest outer surface relative to a center of the largest outer surface in a vertical direction and in a position closer to one end of a left end and a right end of the largest outer surface relative to a center of the largest outer surface in a horizontal direction, and the liquid detecting section is provided in a position closer to a lower end of the largest outer surface relative to the center of the largest outer surface in the vertical direction and in a position closer to the other end, that is opposite to the one end, of the largest outer surface relative to the center of the largest outer surface in the horizontal direction.

With this configuration, viewed in the direction perpendicular to the largest outer surface, when the air introducing port is provided in a position corresponding to the left end and the upper end of the largest outer surface, the liquid detecting section is provided in a position corresponding to the right end and the lower end of the largest outer surface, for example. In other words, the liquid detecting section is provided in a position substantially diagonal with respect to the air introducing port. By providing the air introducing port and the liquid detecting section to be diagonal with respect to each other, the distance from the air introducing port to the liquid detecting section can be made long. When air is introduced, therefore, small air bubbles generated in the vicinity of the air introducing port will not easily reach the liquid detecting section. Consequently, small air bubbles can be prevented from adhering to the liquid detecting section. Further, small air bubbles are pressed and collapsed on the back surface side of the swinging pressure receiving plate before reaching the liquid detecting section, and thereby the small sir bubbles can easily be changed into large air bubbles. Since light scattering is difficult to occur in a case where large air bubbles adhere to the liquid detecting section compared to a case where small air bubbles adhere to the liquid detecting section, false detection can be reduced. Further, it is possible to correspond to high speed printing. Incidentally, viewed in the direction perpendicular to the largest outer surface, when the air introducing port is provided in a position corresponding to the right end and the upper end of the largest outer surface, the liquid detecting section can be provided in a position corresponding to the left end and the lower end of the largest outer surface.

APPLICATION EXAMPLE 2

The valve mechanism of the cartridge according to the above-described application example further includes a lever member in which one end portion of the lever member adapted to contact with a back surface of the pressure receiving plate and the valve body is provided in the other end portion of the lever member, so that the air introducing port is opened or closed in accordance with movement of the lever member transmitted by motion of the pressure receiving plate. The pressure receiving plate further comprises a rim projecting toward the back surface side of the pressure receiving plate. When the cartridge is viewed in the direction perpendicular to the largest outer surface, the rim is provided in an outer periphery of the pressure receiving plate at least other than a portion thereof that overlaps with the lever member.

With this configuration, the rim projecting toward the back surface side of the pressure receiving plate regulates movement of air bubbles from the pressure receiving plate toward a direction of the inner wall. Therefore, air bubbles can be prevented from entering a gap between the outer periphery of the pressure receiving plate and the inner wall of the liquid chamber. Further, since the rim is not provided in the portion that overlaps with the lever member, air bubbles generated in introducing air are actively guided from this portion to the back surface side of the pressure receiving plate. Consequently, large air bubbles can be formed efficiently.

APPLICATION EXAMPLE 3

In the cartridge according to the above-described application example, when the liquid chamber is viewed in the direction perpendicular to the largest outer surface in a state in which the cartridge is installed in the printing device, the inner wall includes a first wall descending from a position below the air introducing port on a side of the one end of the liquid chamber toward the liquid detecting section, the first wall having an end point in a position in front of the liquid detecting section, a second wall descending from a position above the liquid detecting section on a side of the other end of the liquid chamber toward the liquid detecting section, the second wall having an end point in a position in front of the liquid detecting section, and a partition wall provided so as to cover other than the upper side of the liquid detecting section. The liquid detecting section is provided below the end point of the first wall and the end point of the second wall.

With this configuration, small air bubbles entering the gap between the outer periphery of the pressure receiving plate and the inner wall of the liquid chamber are guided toward the liquid detecting section through the first wall in accordance with flow movement of liquid. The small air bubbles are hard to descend toward the liquid detecting section due to the buoyant force even when reaching the end point of the first wall, and move toward the end point of the second wall along the outer periphery of the pressure receiving plate. Then, the small air bubbles are guided to the side of the other end while ascending along the second wall that has an inverse slope with respect to the first wall. Even if the air bubbles, guided to the side of the other end side, return to the liquid detecting section again, the air bubbles are hard to descend toward the detecting section due to the buoyant force, and move to the first wall along the outer periphery of the pressure receiving plate or return to the side of the other end along the second wall. While repeating such movements, air bubbles are united with air bubbles that have become larger on the back side of the pressure receiving plate so as to be changed into much larger air bubbles. Therefore, small air bubbles do not easily adhere to the liquid detecting section, and false detection can be reduced.

APPLICATION EXAMPLE 4

In the cartridge according to the above-described application example, when the cartridge is viewed in the direction perpendicular to the largest outer surface in a state in which the cartridge is installed in the printing device, the end point of the second wall is located above the end point of the first wall.

With this configuration, when the back surface of the pressure receiving plate contacts the inner wall facing the back surface of the pressure receiving plate among the inner wall of the liquid chamber, the sheet member forms a wall to close above the liquid detecting section between the end point of the first wall and the end point of the second wall. Since the end point of the second wall is located above the end point of the first wall, the wall formed by the sheet member has an inverse slope with respect to the slope of the first wall, and thus air bubbles can be guided to the second wall more efficiently and easily. Therefore, small air bubbles do not easily adhere to the liquid detecting section, and false detection can be reduced.

APPLICATION EXAMPLE 5

In the cartridge according to the above-described application example, when the cartridge is viewed in the direction perpendicular to the largest outer surface in a state in which the cartridge is installed in the printing device, a slope of a line connecting the end point of the first wall and the end point of the second wall is larger than the slope of the first wall.

With this configuration, the wall formed by the sheet member has an inverse slope larger than the slope of the first wall, and thus air bubbles are easily guided to the second wall. Therefore, small air bubbles do not easily adhere to the liquid detecting section, and false detection can be reduced.

APPLICATION EXAMPLE 6

The rim of the cartridge according to the above-described application example is not provided in a part of a portion thereof facing the second wall.

With this configuration, air bubbles, pressed and collapsed on the back surface side of the pressure receiving plate so as to become large air bubbles, are easily guided from the portion with no rim to the second wall. Therefore, air bubbles guided from the portion with no rim and air bubbles guided from the first wall to the second wall are easily united with each other, so that much larger air bubbles can be formed.

APPLICATION EXAMPLE 7

In the cartridge according to the above-described application example, when the cartridge is viewed in the direction perpendicular to the largest outer surface in a state in which the cartridge is installed in the printing device, a projecting portion is provided in a position of a third wall facing the back surface of the pressure receiving plate among the inner wall close to the other end, and the projecting section serves as a rotation fulcrum of the pressure receiving plate when the back surface of the pressure receiving plate approaches the third wall.

With this configuration, when the pressure receiving plate moves to the third wall, the back surface of the pressure receiving plate abuts against the apex of the projecting portion, and thus the pressure receiving plate does not completely contact the inner wall of the liquid chamber. In other words, a gap is formed between the inner wall facing the back surface of the pressure receiving plate and the back surface of the pressure receiving plate, and thus air bubbles are not easily ejected from the back surface of the pressure receiving plate to the outside of the outer periphery of the pressure receiving plate. Consequently, even when the remaining amount of the liquid in the liquid chamber becomes small, large air bubbles can be formed on the back surface of the pressure receiving plate.

BRIEF DESCRIPTION OF THE DRAWINGS

Referring now to the attached drawings which form a part of this original disclosure.

DETAILED DESCRIPTION OF EXEMPLARY EMBODIMENTS

Hereinafter, embodiments of the invention will be described. In the attached drawings, there are cases in which the size of each member is illustrated differently from the actual size so as to make the size of each member observable.

Configuration of Liquid Injection System

Figure 1:
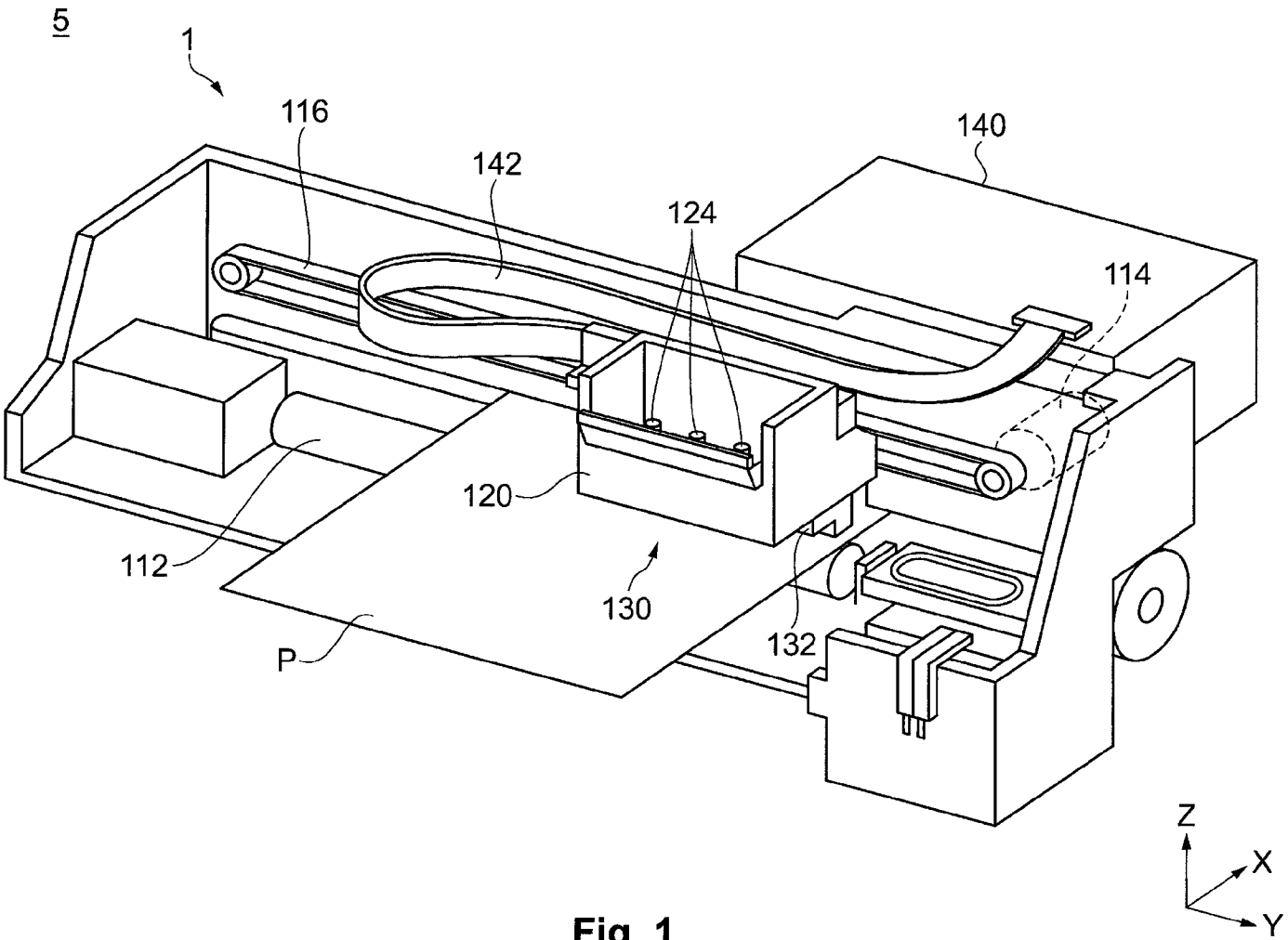
FIG. 1 is a perspective view that illustrates a configuration of a liquid injection system.

First, the configuration of the liquid injection system will be described. FIG. 1 is a perspective view that illustrates the configuration of the liquid injection system. An X axis, a Y axis, and a Z axis orthogonal to each other are illustrated in FIG. 1 for easy understanding. The X axis, the Y axis, and the Z axis orthogonal to each other are illustrated in the subsequent drawings as needed.

A liquid injection system 5 has a printing device 1, and an ink cartridge (not shown in the drawing) as a cartridge that stores ink as liquid to be supplied to the printing device 1. The printing device 1 is an ink-jet printer for individual users, and includes a sub scanning feeding mechanism, a main scanning feeding mechanism, and a head driving mechanism. The sub scanning feeding mechanism delivers printing paper P in a sub scanning direction with a paper feeding roller 112 which uses a paper feeding motor as motive power. The paper feeding motor is not shown in the drawing. The main scanning feeding mechanism moves a carriage 130, connected to a driving belt 116, back and forth in a main scanning direction using motive power of a carriage motor 114. The main scanning direction of the printing device 1 is the Y axis direction, and the sub scanning direction thereof is the X axis direction. The head driving mechanism drives a printing head 132 provided in the carriage 130 so as to conduct ejection of ink as liquid and formation of dots. The printing device 1 further includes a control section 140 for controlling each of the above-described mechanisms. The control section 140 is connected to the carriage 130 through a flexible cable 142.

The carriage 130 includes a holder 120, and the printing head 132. The holder 120 is configured such that a plurality of ink cartridges can be installed therein, and is disposed above the printing head 132. Hereinafter, the holder 120 is also referred to as a "cartridge installing section 120". In the example shown in FIG. 1, four ink cartridges can be installed independently. For example, four kinds of ink cartridges for black, yellow, magenta, and cyan are installed, respectively. As the holder 120, another holder can be used as long as a plurality of optional kinds of ink cartridges other than the above can be installed. A liquid supply tube 124 is provided above the printing head 132 so as to supply ink from the ink cartridge to the printing head 132. The printing head 132 serves as a liquid injecting section that injects ink by ejecting ink. This type of printing device such as the printing device 1 in which an ink cartridge to be replaced by a user is installed in the cartridge installing section (holder) 120 on the carriage 130 of the printing head 132 is called as an "on-carriage type".

Outer Appearance Configuration of Ink Cartridge

Figure 2:
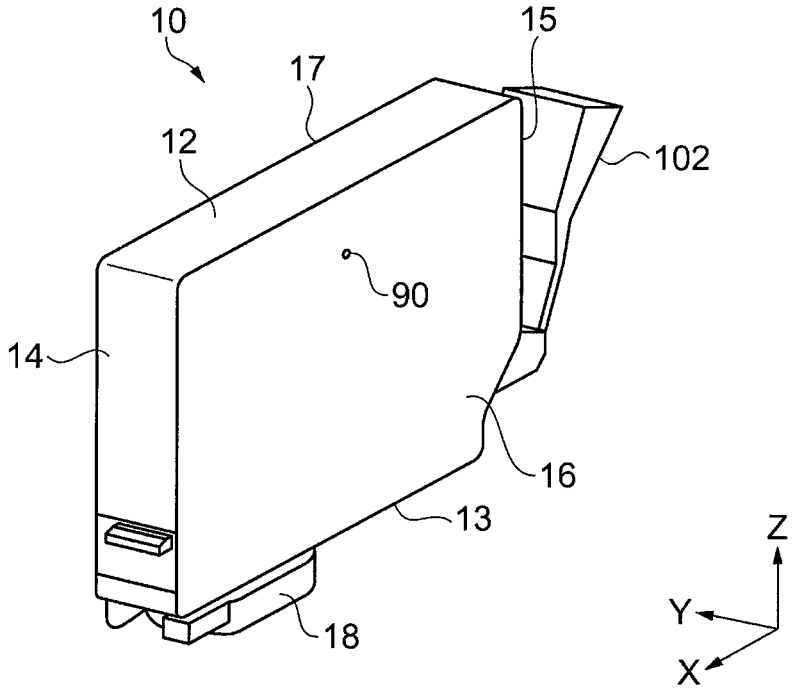
FIG. 2 is an outer appearance perspective view that illustrates a configuration of an ink cartridge.

Next, an outer appearance configuration of an ink cartridge will be described. FIG. 2 is an outer appearance perspective view that illustrates a configuration of an ink cartridge. In an installed state in which an ink cartridge 10 (hereinafter also referred to as "cartridge 10") is installed in the printing device 1, the Z axis negative direction is a vertically downward direction. In the installed state, the printing device 1 is disposed in a flat plane parallel to the X axis and the Y axis. The contour of the cartridge 10 is substantially cuboid. The cartridge 10 has a first surface 12, a second surface 13, a third surface 14, a fourth surface 15, a fifth surface 16, and a sixth surface 17. Each surface 12-17 forms the outer surface of the cartridge 10. The first surface 12 and the second surface 13 face each other. The third surface 14 and the fourth surface 15 face each other. The fifth surface 16 and the sixth surface 17 face each other. Among these outer surfaces, the fifth surface 16 and the sixth surface 17 are the largest outer surfaces whose areas are the largest. In the present embodiment, a direction perpendicular to the fifth surface 16 or the sixth surface 17 which are the largest outer surfaces is the Y axis direction.

A lever 102 is provided in the fourth surface 15. The lever 102 has a function of an engaging section for retaining the cartridge 10 with respect to the holder 120 by engaging with a part of the holder 120. The lever 102 is also used for attaching or removing the cartridge 10 with respect to the holder 120. The functions of the engaging section or the member for attaching or removing can be achieved with an embodiment other than the lever 102. Alternatively, it can possible to provide only one of the functions of the engaging section or the member for attaching or removing in the fourth surface 15. An outer air introducing port 90 is formed in the fifth surface 16 so as to introduce air from the outside of the cartridge 10 to the inside of the cartridge 10 by connecting the outside to the inside of the cartridge 10. A liquid supply port 18 is provided in the second surface 13 so as to supply ink, stored in the cartridge 10, to the printing device 1. When the cartridge 10 is installed in the printing device 1, the liquid supply port 18 is connected to the liquid supply tube 124.

Detailed Configuration of Ink Cartridge

Figure 3:
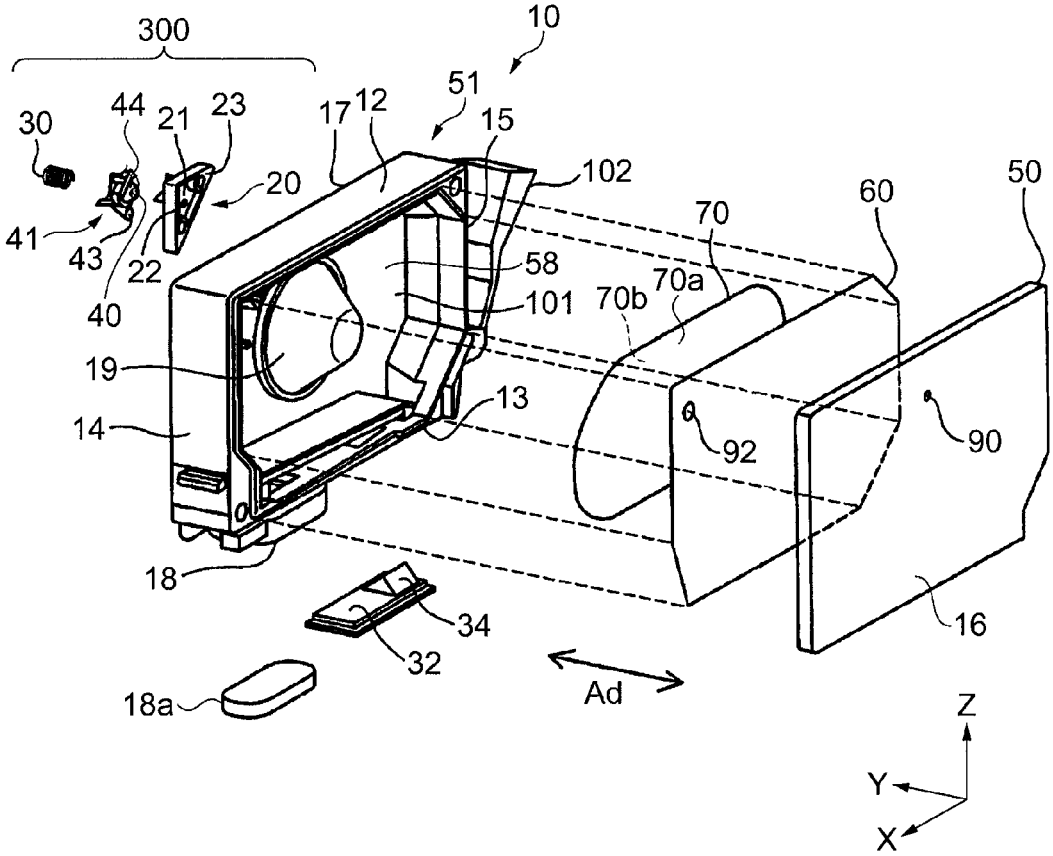
FIG. 3 is an exploded perspective view that illustrates the configuration of the ink cartridge.
Figure 4:
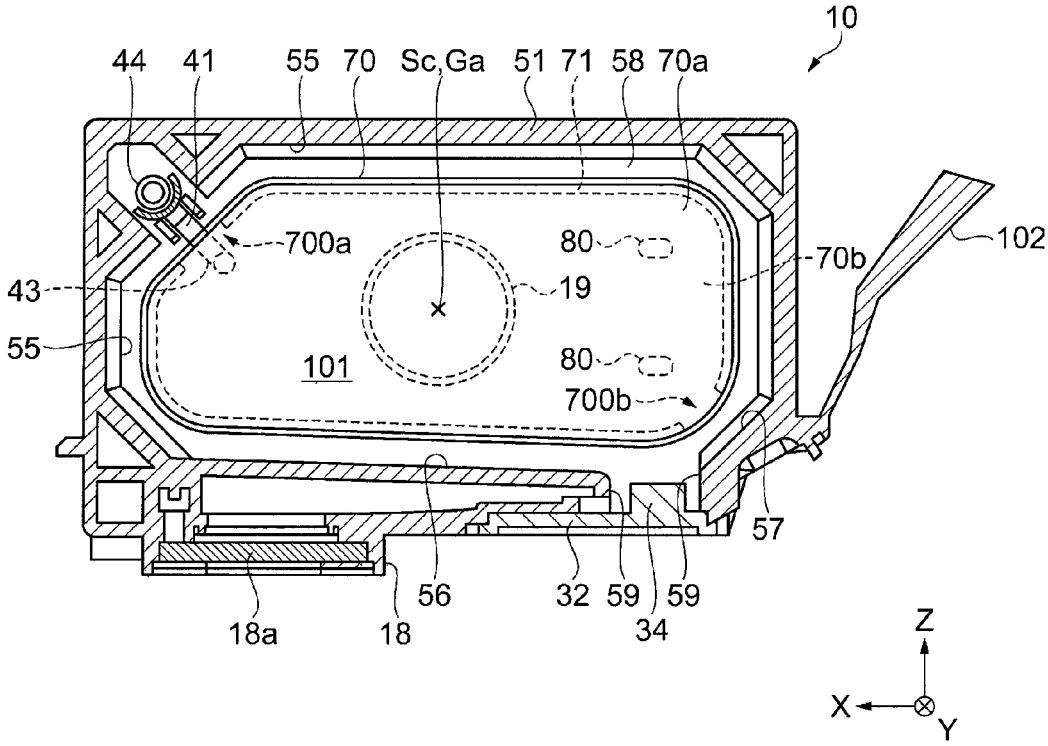
FIG. 4 is a sectional view that illustrates the configuration of the ink cartridge.
Figure 5:
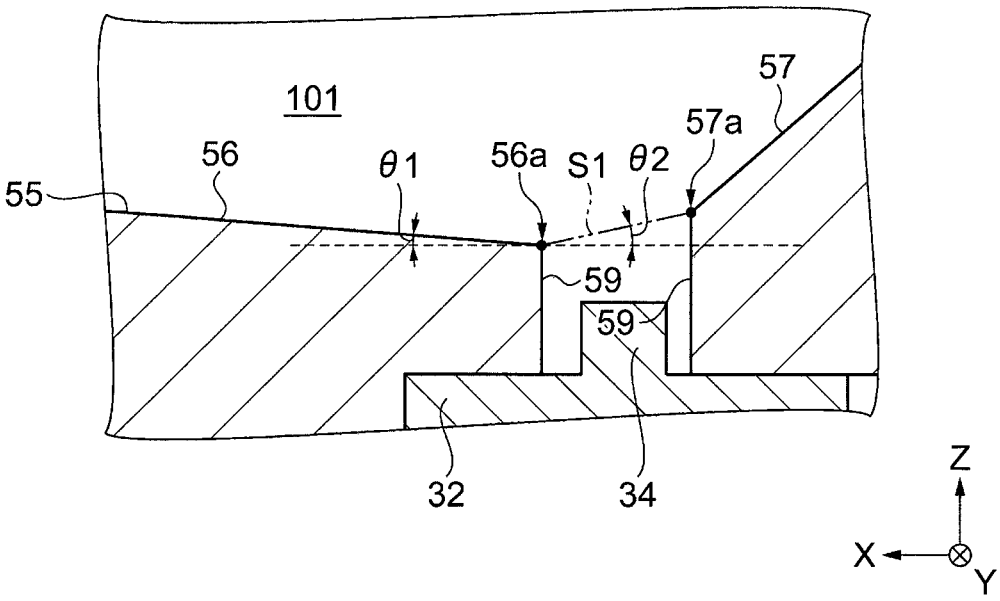
FIG. 5 is a schematic diagram that enlarges a part of the ink cartridge.

Next, a detailed configuration of the ink cartridge 10 will be described. FIG. 3 is an exploded perspective view that illustrates the configuration of the ink cartridge. FIG. 4 is a sectional view of the ink cartridge. FIG. 5 is a schematic diagram that enlarges a part of the ink cartridge. As shown in FIG. 3, the cartridge 10 has a reservoir main body member 51 and a lid member 50. The outer surfaces of the cartridge 10 are formed by the reservoir main body member 51 and the lid member 50. The cartridge 10 also has a valve mechanism 300, a coil spring 19 as a first biasing member, a pressure receiving plate 70, and a sheet member (film member) 60.

The reservoir main body member 51 and the lid member 50 are made of synthetic resin such as polypropylene or the like. The sheet member 60 is made of synthetic resin (for example, a material containing nylon and polypropylene), and has flexibility.

The reservoir main body member 51 has an inner wall 55. The inner wall 55 forms a concave shape. A side surface of the reservoir main body member 51 is open. As shown in FIG. 4, the inner wall 55 has a first wall 56, a second wall 57, a third wall 58, and a partition wall 59. The sheet member 60 is attached to the reservoir main body member 51 so as to cover the opening in the side surface of the reservoir main body member 51. With this configuration, a liquid chamber 101 for storing ink is formed. Specifically, the liquid chamber 101 is formed by the inner wall 55 that partitions the inner space of the cartridge 10, and the flexible sheet member 60. With this configuration, the volume of the liquid chamber 101 can be changed. The sheet member 60 is attached to the reservoir main body member in a state of being pressed and spread along the concave shape of the inner wall 55 so as to easily correspond to change in the volume of the liquid chamber 101. A ventilation hole 92 is formed in the sheet member 60. Consequently, the cartridge 10 is configured such that air (outside air) can pass through the outer air introducing port 90 and the ventilation hole 92 and flow to the liquid chamber 101 via the valve mechanism 300 described below.

The pressure receiving plate 70 is made of synthetic resin such as polypropylene, or metal such as stainless steel. The pressure receiving plate 70 is disposed inside the liquid chamber 101. A surface 70*a* of the pressure receiving plate 70 contacts the sheet member 60. A rim 71 projecting toward a back surface 70*b* of the pressure receiving plate 70 is provided in substantially all the outer periphery of the pressure receiving plate 70 except a part of the outer periphery. In the present embodiment, as shown in FIG. 4, the rim 71 is provided in the outer periphery at least other than a portion 700*a* that overlaps with a lever member 41 (described below) in a planar view, that is, in a case of being viewed in the Y axis direction. Also, as shown in FIG. 4, the outer periphery of the pressure receiving plate 70 has a slightly smaller shape than the outer periphery of the liquid chamber 101 that surrounds the inner wall 55 (side wall) except a portion of a prism 34 (described below) as a liquid detecting section. With this configuration, the gap between the outer periphery of the pressure receiving plate 70 and the inner wall 55 (side wall) of the liquid chamber 101 becomes small. Therefore, air bubbles can hardly enter the gap, and can easily be guided toward the back surface 70*b* of the pressure receiving plate 70.

As schematically shown in FIG. 3, the coil spring 19 wound in a circular truncated cone shape is disposed inside the liquid chamber 101. The coil spring 19 is provided between the pressure receiving plate 70 and the third wall 58 on the back side of the sixth surface 17 of the cartridge 10 among the inner wall 55 of the reservoir main body member 51. The lower base portion of the coil spring 19 abuts the inner wall on the back side of the sixth surface 17. The lower base portion of the coil spring 19 is disposed within a circular frame provided in the third wall 58. The upper base portion of the coil spring 19 abuts the back surface 70*b* opposite to the surface 70*a* that contacts the sheet member 60 among the two surfaces of the pressure receiving plate 70. Further, the upper base portion of the coil spring 19 abuts a substantially central portion of the back surface 70*b* of the pressure receiving plate 70. Here, the substantially central portion of the back surface 70*b* of the pressure receiving plate 70 refers to a portion where the center of gravity of the pressure receiving plate 70 is located when the pressure receiving plate 70 is vertically projected onto a plane parallel to the back surface 70*b*. Also, it is sufficient that the state in which "the coil spring 19 abuts the substantially central portion of the back surface 70*b* of the pressure receiving plate 70" is a state in which a region (a circle region in the present embodiment) formed by a portion where the coil spring 19 actually abuts the pressure receiving plate 70 is in a position that includes the substantially central portion of the back surface 70*b*. In the present embodiment, it is configured such that the lower base portion of the coil spring 19 abuts the inner wall of the reservoir main body member 51 and the upper base portion of the coil spring 19 abuts the back surface 70*b* of the pressure receiving plate 70. However, it can be configured such that the upper base portion and the lower base portion are inverted.

The coil spring 19 biases the pressure receiving plate 70 from the back surface 70*b* side of the pressure receiving plate 70. In other words, the coil spring 19 presses the pressure receiving plate 70 from the back surface 70*b* side of the pressure receiving plate 70 to the surface 70*a* side of the pressure receiving plate 70. More specifically, the coil spring 19 biases the pressure receiving plate 70 from the back surface 70*b* side of the pressure receiving plate 70 in the negative Y axis direction. The coil spring 19 biases the pressure receiving plate 70 in a direction for expanding the volume of the liquid chamber 101. The coil spring 19 expands and shrinks (moves) along a direction Ad (FIG. 3) that is a direction along the Y axis direction. As shown in FIG. 4, viewed in the Y axis direction, the coil spring 19 abuts the pressure receiving plate 70 such that a central axis Sc of the coil spring 19 and the center of gravity Ga of the pressure receiving plate 70 overlap each other. Specifically, it is configured such that the central axis Sc and the center of gravity Ga overlap each other when the cartridge 10 is vertically projected onto a plane (parallel to the X axis and the Z axis) perpendicular to a direction (Y axis direction) in which the coil spring 19 expands and shrinks.

The lid member 50 is attached to the reservoir main body member 51 so as to cover the sheet member 60. Accordingly, the sheet member 60 is protected from the outside.

The valve mechanism 300 has a spring member 30 as a second biasing member, a valve body 40, and a cover valve 20. The cover valve 20 is housed in a corner portion of the reservoir main body member 51 in which the first surface 12 and the third surface 14 intersect each other, and is attached to the reservoir main body member 51. The cover valve 20 is made of synthetic resin such as polypropylene, for example. The cover valve 20 has a concave shape. The sheet member 60 is hermetically attached to an end surface 23 that forms an opening. The concave portion of the cover valve 20 serves as an air connecting chamber 21. An inner air introducing port 22 is formed in the bottom of the air connecting chamber 21 so as to penetrate to the back side of the cover valve 20. The ventilation hole 92 of the sheet member 60 is connected to the air connecting chamber 21. Specifically, the inner air introducing port 22 introduces air, introduced from the outer air introducing port 90 to the inside of the cartridge 10, to the liquid chamber 101. Introduction of air to the liquid chamber 101 can be adjusted by opening or closing the inner air introducing port 22 with the valve mechanism 300.

The valve mechanism 300 further includes the lever member 41 in which one end portion of the lever member 41 can contact the back surface 70*b* of the pressure receiving plate 70 and the valve body 40 is provided in the other end portion of the lever member 41. The spring member 30 biases the valve body 40 in a direction for closing the inner air introducing port 22 (the negative Y axis direction in the present embodiment). The valve body 40 is pressed onto the cover valve 20 by the spring member 30 so as to cover the inner air introducing port 22. The lever member 41 has a first lever portion 44 and a second lever portion 43. The first lever portion 44, in which the valve body 40 is provided, is pressed by the spring member 30 so as to cover the inner air introducing port 22. The second lever portion 43 is disposed such that it can contact the back surface 70*b* of the pressure receiving plate 70 in accordance with displacement of the pressure receiving plate 70. More specifically, as shown in FIG. 4, viewed in the Y axis direction, the second lever portion 43 and the pressure receiving plate 70 are disposed so as to overlap each other. Incidentally, the rim 71 provided in the pressure receiving plate 70 is not provided in a portion thereof that overlaps with the lever member 41 viewed in the Y axis direction. The lever member 41 can be made of synthetic resin such as polypropylene, for example. The valve body 40 can be formed with double molding by using an elastic member such as elastomer for the first lever portion 44 and using synthetic resin such as polypropylene for the other portion.

A foam (porous member) 18*a* is disposed in a flow passage through which ink flows from the liquid chamber 101 of the liquid supply port 18 toward the outside. The foam 18*a* is made of synthetic resin such as polyethylene terephthalate, for example. In the installed state in which the cartridge 10 is installed in the printing device 1, the foam 18*a* contacts the liquid supply tube 124 so as to flow ink toward the printing device 1.

As shown in FIG. 3 and FIG. 4, the cartridge 10 has a prism unit 32. The prism unit 32 is disposed inside the liquid chamber 101, and includes the prism 34 as a liquid detecting section that optically detects whether ink exists or not. The prism 34 is formed by projecting a part of a surface of the prism unit 32 in a triangular prism shape toward the liquid chamber 101. The prism unit 32 is a transparent member made of synthetic resin such as polypropylene, for example. The member constituting the prism unit 32 can not be transparent as long as it has appropriate light permeability. Also, the prism unit 32 can be composed by separate members including the portion of the prism 34 and the other portion. In such a case, only the portion of the prism 34 can be composed of a transparent member. The prism unit 32 is attached to the second surface 13 such that the prism 34 is located inside the liquid chamber 101. Existence or non-existence of link in the liquid chamber 101 is detected as follows, for example. An optical sensor having a light emitting element and a light receiving element is provided in the printing device 1. Light is emitted from the light emitting element toward the prism 34. When ink exists in the vicinity of the prism 34, light is transmitted through the prism 34 and goes to the liquid chamber 101. On the other hand, when ink does not exist in the vicinity of the prism 34, light emitted from the light emitting element is reflected on two reflection surfaces of the prism 34 and reaches the light receiving element. The printing device 1 detects whether ink exists or not in the liquid chamber 101 based on whether light reaches the light receiving element or not.

Positional Relation of Each Member in Ink Cartridge

The positional relation of each member of the cartridge 10 will be described. First, the positional relation between the inner air introducing port 22 and the prism unit 32, in particular, between the inner air introducing port 22 and the prism 34 will be described.

When the cartridge 10 is viewed in a direction (the Y axis direction) perpendicular to the largest outer surface (the fifth surface 16 or the sixth surface 17) whose area is the largest among a plurality of outer surfaces (the first to sixth surfaces 12, 13, 14, 15, 16, and 17) of the cartridge 10 in a state in which the cartridge 10 is installed in the printing device 1, the inner air introducing port 22 is provided in a position closer to an upper end of the largest outer surface relative to a center of the largest outer surface in a vertical direction and in a position closer to one end of a left end and a right end of the largest outer surface relative to a center of the largest outer surface in a horizontal direction, and the prism 34 is provided in a position closer to a lower end of the largest outer surface relative to the center of the largest outer surface in the vertical direction and in a position closer to the other end of the left end and the right end of the largest outer surface relative to the center of the largest outer surface in the horizontal direction.

More specifically, as shown in FIG. 4, for example, when the cartridge 10 is viewed in the direction (the positive Y axis direction) perpendicular to the fifth surface 16 in a state in which the cartridge 10 is installed in the printing device 1, the inner air introducing port 22 is provided in a position closer to the upper end of the fifth surface 16 relative to the center of the fifth surface 16 in the vertical direction and in a position closer to the left end as the one end of the fifth surface 16 relative to the center of the fifth surface 16 in the horizontal direction, and the prism 34 is provided in a position closer to the lower end of the fifth surface 16 relative to the center of the fifth surface 16 in the vertical direction and in a position closer to the right end as the other end of the fifth surface 16 relative to the center of the fifth surface 16 in the horizontal direction. In other words, the inner air introducing port 22 and the prism 34 are provided in a position substantially diagonal with respect to each other. By providing the inner air introducing port 22 and the prism 34 in this manner, the distance from the inner air introducing port 22 to the prism 34 can be made long.

As shown in FIG. 4 and FIG. 5, viewed in the positive Y axis direction in a state in which the cartridge 10 is installed in the printing device 1, the inner wall 55 of the liquid chamber 101 includes the first wall 56 that descends from a position below the inner air introducing port 22 on the left end side as the one end toward the prism 34 and has an end point 56*a* in a position in front of the prism 34, the second wall 57 that descends from a position above the prism 34 on the right end side as the other end of the liquid chamber 101 toward the prism 34 and has an end point 57*a* in a position in front of the prism 34, and a partition wall 59 that is provided so as to cover other than the upper side of the prism 34. The prism 34 is provided below the end points of the first wall 56 and the second wall 57. The end point 57*a* of the second wall 57 is located above the end point 56*a* of the first wall 56 with respect to the Z axis direction. Further, it is configured such that a second slope θ2 of a line S1 connecting the end point 56*a* of the first wall 56 and the end point 57*a* of the second wall 57 is larger than a first slope θ1 of the first wall 56.

In the present embodiment, as shown in FIG. 4, viewed in the Y axis direction (the positive Y axis direction), the rim 71 of the pressure receiving plate 70 is not provided in the portion 700*a* that overlaps with the lever member 41 and a part 700*b* of a portion that faces the second wall 57.

Further, as shown in FIG. 4, viewed in the Y axis direction in a state in which the cartridge 10 is installed in the printing device 1, a projecting portion 80 is provided in a position of the third wall 58 that faces the back surface 70*b* of the pressure receiving plate 70 among the inner wall 55 of the liquid chamber 101 close to the right end as the other end, and the projecting section 80 serves as a rotation fulcrum of the pressure receiving plate 70 when the back surface 70*b* of the pressure receiving plate 70 approaches the third wall 58.

Operation of Ink Cartridge

Next, the operation of the cartridge 10 will be described. FIGS. 6A-6C and FIGS. 7A-7B are schematic diagrams that illustrate an operation of the ink cartridge. FIGS. 6A-6C and FIGS. 7A-7B are diagrams that schematically illustrate sections of different parts of the cartridge 10, respectively. Both are schematic diagrams that explain the inner state of the cartridge 10 for easy understanding, and are not precise sectional views.

Figure 6A:
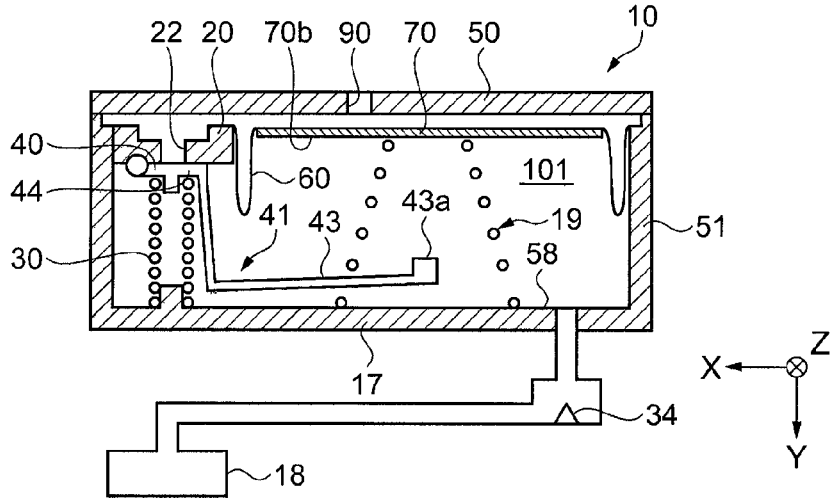
FIGS. 6A-6C are schematic diagrams that illustrate an operation of the ink cartridge.
Figure 7A:
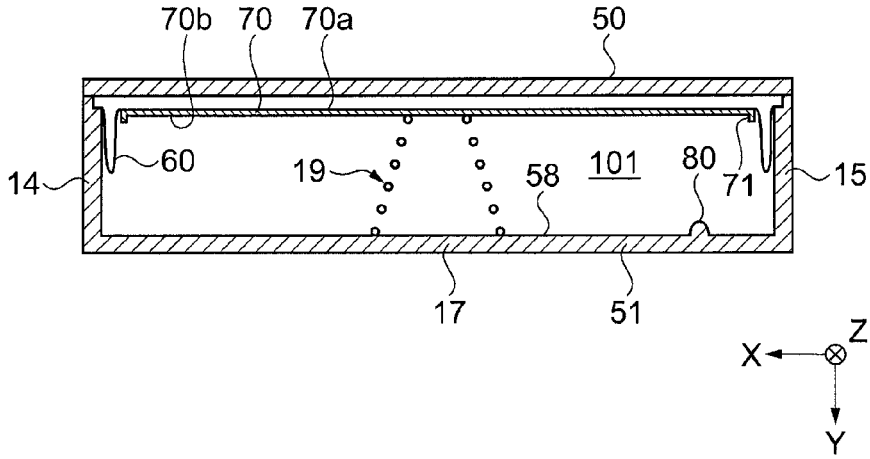
FIGS. 7A-7B are schematic diagrams that illustrate the operation of the ink cartridge.

The liquid chamber 101 is filled with ink in a state where the cartridge 10 is new. In this state, as shown in FIG. 6A and FIG. 7A, the inner air introducing port 22 is blocked by pressing the first lever portion 44 toward the inner air introducing port 22 with the spring member 30. Specifically, the valve body 40 is in a closed valve state. Therefore, the liquid chamber 101 is in a sealed state. Also, the coil spring 19 of the liquid chamber 101 biases the pressure receiving plate 70 in a direction for expanding the volume of the liquid chamber 101 covered by the sheet member 60. As a result, the pressure in the liquid chamber 101 is maintained in an appropriate pressure range suitable for supplying ink to the printing head 132. The appropriate pressure range is pressure lower than the atmospheric pressure (negative pressure).

Next, ink in the liquid chamber 101 is supplied to the printing device 1. More specifically, ink in the liquid chamber 101 is supplied from the liquid supply port 18 to the printing device 1 via a detecting chamber formed around the prism 34. As the ink in the liquid chamber 101 is supplied to the printing device 1 and the ink in the liquid chamber 101 is consumed, the volume of the liquid chamber 101 is decreased. Specifically, the pressure receiving plate 70 moves toward the third wall 58 against the biasing force of the coil spring 19. As the pressure receiving plate 70 moves toward the third wall 58, the biasing force of the coil spring 19 becomes large, which increases the negative pressure of the liquid chamber 101.

Figure 6B:
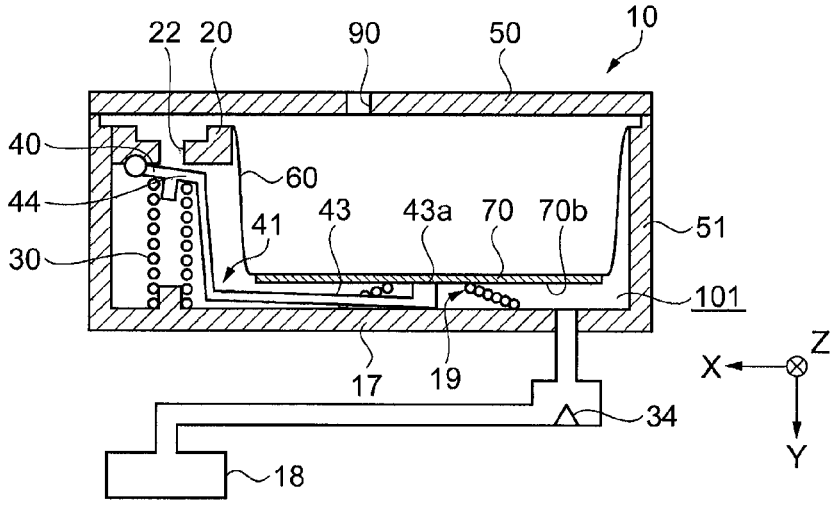

When the ink in the liquid chamber 101 is consumed and the pressure receiving plate 70 further moves toward the third wall 58, the pressure receiving plate 70 presses the second lever portion 43 (in more detail, a protrusion 43*a*) toward the third wall 58 as shown in FIG. 6B. Then, the first lever portion 44 is displaced so as to separate from the inner air introducing port 22 against the biasing force of the spring member 30, and the inner air introducing port 22 is temporarily placed in a connecting state. Specifically, the valve body 40 is in an opened valve state. When the inner air introducing port 22 is placed in a connecting state, outside air is introduced from the outer air introducing port 90 to the liquid chamber 101 through the ventilation hole 92 and the inner air introducing port 22.

Figure 7B:
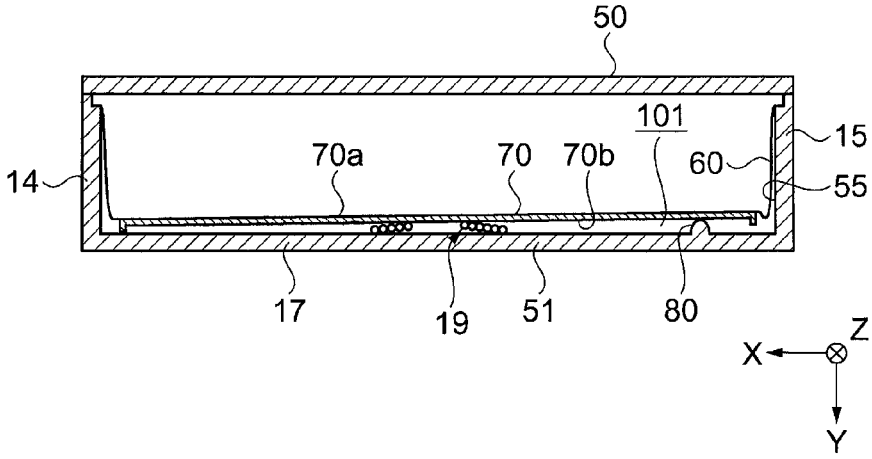

Also, as shown in FIG. 7B, when the pressure receiving plate 70 descends to the vicinity of the third wall 58 and the back surface 70*b* of the pressure receiving plate 70 abuts against the projecting portion 80 formed on the surface of the third wall 58, one end of the pressure receiving plate 70 is pressed down with respect to the projecting section 80 as the rotation fulcrum. In the present embodiment, an end portion of the pressure receiving plate 70 on the side of the third surface 14 is pressed down. Since the valve mechanism 300 is provided on the side of the third surface 14, the pressure receiving plate 70 can securely press the second lever portion 43 when descending to the vicinity of the third wall 58. Also, since movement of the pressure receiving plate 70 is regulated by the projecting section 80, a gap is formed between the back surface 70*b* of the pressure receiving plate 70 and the third wall 58. In the present embodiment, the gap on the side of the fourth surface 15 is larger than the gap on the side of the third surface 14.

Figure 6C:
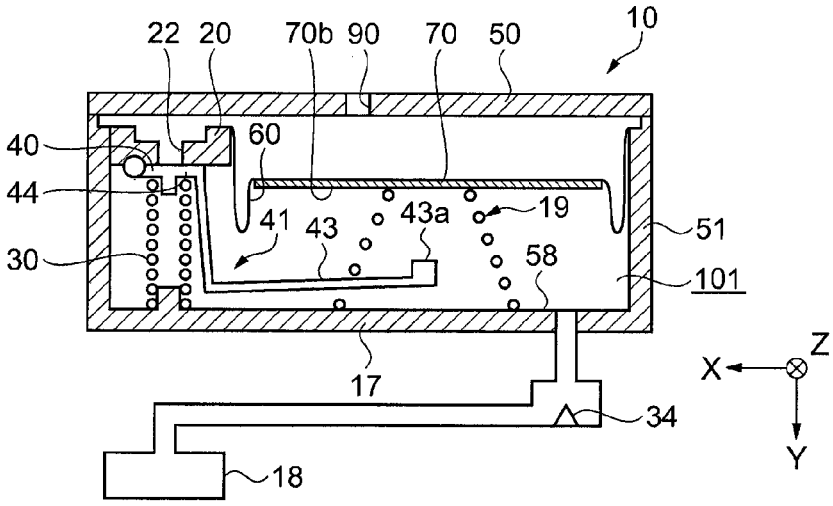

Next, when air is introduced to the liquid chamber 101, the volume of the liquid chamber 101 becomes large by the amount of introduced air. At the same time, the negative pressure in the liquid chamber 101 becomes slightly small (close to the atmospheric pressure). Then, as shown in FIG. 6C, when air is introduced to the liquid chamber 101 to some extent, the pressure receiving plate 70 is separated from the second lever portion 43. When the pressure receiving plate 70 is separated from the second lever portion 43, the valve body 40 is placed in a closed valve state. Therefore, introduction of air to the liquid chamber 101 through the inner air introducing port 22 is stopped. In this manner, when the negative pressure in the liquid chamber 101 becomes large as the ink in the liquid chamber 101 is consumed, the valve body 40 is temporarily placed in an opened valve state. Accordingly, the pressure in the liquid chamber 101 can be maintained in an appropriate pressure range.

Subsequently, as the ink in the liquid chamber 101 is consumed, movements of the pressure receiving plate 70 in a direction toward the third wall 58 and in a direction away from the third wall 58 are repeated. Then, the valve body 40 is placed in an opened valve state or a closed valve state in accordance with the movements of the pressure receiving plate 70, thereby adjusting introduction of air to the liquid chamber 101.

As described above, according to the present embodiment, the following effects can be achieved.

(1) The inner air introducing port 22 is provided in a position closer to the upper end of the fifth surface 16 relative to the center of the fifth surface 16 in the vertical direction and in a position closer to the left end of the fifth surface 16 relative to the center of the fifth surface 16 in the horizontal direction, and the prism 34 is provided in a position closer to the lower end of the fifth surface 16 relative to the center of the fifth surface 16 in the vertical direction and in a position closer to the right end of the fifth surface 16 relative to the center of the fifth surface 16 in the horizontal direction. In other words, the inner air introducing port 22 and the prism 34 are provided in a position substantially diagonal with respect to each other. By providing the inner air introducing port 22 and the prism 34 in this manner, the distance from the inner air introducing port 22 to the prism 34 can be made long. Therefore, air bubbles in the ink generated in introducing air from the inner air introducing port 22 will not easily reach the prism 34, and false detection due to adhesion of air bubbles to the prism 34 can be reduced. Also, small air bubbles generated in introducing air from the inner air introducing port 22 move toward the direction of the prism 34 in accordance with the flow movement of the ink. On the other hand, as the ink in the liquid chamber 101 is consumed, movements of the pressure receiving plate 70 in a direction toward the third wall 58 and in a direction away from the third wall 58 are repeated. Then, small air bubbles are pressed and collapsed in accordance with the movement (swing movement) of the pressure receiving plate 70, and the small air bubbles are united so as to form large air bubbles. Therefore, eventually large air bubbles adhere to the prism 34. However, since light scattering is difficult to occur in a case where large air bubbles adhere to the prism 34 compared to a case where small air bubbles adhere to the prism 34, false detection can be reduced.

(2) The rim 71 of a projecting shape is provided on the back surface 70*b* of the pressure receiving plate 70. The movements of air bubbles toward a direction of the inner wall 55 are regulated by the rim 71, and small air bubbles whose movements are regulated can easily form large air bubbles in accordance with the movement (swing movement) of the pressure receiving plate 70. Also, air bubbles can be prevented from entering the gap between the outer periphery of the pressure receiving plate 70 and the inner wall 55 of the liquid chamber 101. Further, since the rim 71 is not provided in the portion 700*a* in which the rim 71 overlaps with the lever member 41 in a planar view, air bubbles can easily be guided from this portion toward the back surface 70*b* of the pressure receiving plate 70. Therefore, large air bubbles can be formed efficiently in accordance with the movement (swing movement) of the pressure receiving plate 70.

(3) Since the prism 34 is provided below the end point 56*a* of the first wall 56 and the end point 57*a* of the second wall 57, small air bubbles entering the gap between the outer periphery of the pressure receiving plate 70 and the inner wall 55 of the liquid chamber 101 are guided toward the prism 34 through the first wall 56 in accordance with the flow movement of the ink. The guided air bubbles are hard to descend toward the prism 34 due to the buoyant force even when reaching the end point 56*a* of the first wall 56, so as to move toward the end point 57*a* of the second wall 57 along the outer periphery of the pressure receiving plate 70, and are guided to the right end side while ascending along the second wall 57 that has an inverse slope with respect to the first wall 56 (see FIG. 4). Even if the air bubbles, guided to the right end side, return to the prism 34 again, the air bubbles are hard to descend toward the prism 34 due to the buoyant force, and move to the first wall 56 along the outer periphery of the pressure receiving plate 70 or return to the right end side along the second wall 57. While repeating such movements, air bubbles are united with air bubbles that have been formed into larger ones in accordance with the movement (swing movement) of the pressure receiving plate 70, and are changed into much larger air bubbles. Therefore, small air bubbles do not easily adhere to the prism 34, and false detection can be reduced.

(4) When the back surface 70*b* of the pressure receiving plate 70 contacts the third wall 58 facing the back surface 70*b* of the pressure receiving plate 70 among the inner wall 55 of the liquid chamber 101, the sheet member 60 forms a wall between the end point 56*a* of the first wall 56 and the end point 57*a* of the second wall 57 to close above the prism 34. Since the end point 57*a* of the second wall 57 is located above the end point 56*a* of the first wall 56, the wall formed by the sheet member 60 has an inverse slope with respect to the first slope θ1 of the first wall 56, and thus air bubbles can be guided toward the second wall 57 more efficiently and easily. Therefore, small air bubbles do not easily adhere to the prism 34, and false detection can be reduced.

(5) Further, since the second slope θ2 of the wall formed by the sheet member 60 has an inverse slope larger than the slope of the first wall 56, air bubbles can easily be guided toward the second wall 57. Therefore, small air bubbles do not easily adhere to the prism 34, and false detection can be reduced.

(6) Further, the rim 71 is not provided in the part 700*b* of a portion that faces the second wall 57. Consequently, large air bubbles pressed and collapsed on the back surface 70*b* side of the pressure receiving plate 70 can easily be guided from the part 700*b* toward the second wall 57. Then, the large air bubbles and the small air bubbles guided from the first wall 56 toward the second wall 57 are easily united on the portion of the second wall 57 so as to easily form large air bubbles.

(7) The projecting portion 80 is provided on the surface of the third wall 58. With this configuration, when the pressure receiving plate 70 moves toward the third wall 58, the back surface 70*b* of the pressure receiving plate 70 does not completely contact the third wall 58 of the liquid chamber 101. Specifically, a gap is formed between the third wall 58 facing the back surface 70*b* of the pressure receiving plate 70 and the back surface 70*b* of the pressure receiving plate 70, and thus air bubbles are not easily ejected from the back surface 70*b* of the pressure receiving plate 70 to the outside of the outer periphery of the pressure receiving plate 70. Consequently, even when the remaining amount of the liquid in the liquid chamber 101 becomes small, large air bubbles can be formed on the back surface 70*b* side of the pressure receiving plate 70.

In the above-described embodiment, as shown in FIG. 4, viewed in the positive Y direction, the inner air introducing port 22 is provided in a position closer to the upper left end of the fifth surface 16 that is the largest outer surface, and the prism 34 is provided in a position closer to the lower right end of the fifth surface 16. However, the right and left relation can be inversed. Specifically, the inner air introducing port 22 can be provided in a position closer to the upper right end of the fifth surface 16 that is the largest outer surface, and the prism 34 can be provided in a position closer to the lower left end of the fifth surface 16.

The invention is not limited to the ink-jet printer and the ink cartridge thereof, and the invention can be applied to any printing device that injects liquid other than ink, and a cartridge thereof. For example, the invention can be applied to various kinds of printing devices, and cartridges thereof, as follows.

(1) an image recording device such as a facsimile device, (2) a printing device that injects a color material used for manufacturing a color filter for an image display device such as a liquid crystal display or the like, (3) a printing device that injects an electrode material for forming an electrode for an organic EL (Electro Luminescence) display, a surface emitting display (Field Emission Display, FED), or the like, (4) a printing device that injects liquid containing a living organic material used for manufacturing a biochip, (5) a sample printing device as a precision pipette, (6) a printing device for lubricant oil, (7) a printing device for resin liquid, (8) a printing device that injects lubricant oil to a precision instrument such as a timepiece or a camera by pinpointing, (9) a printing device that injects transparent resin liquid such as ultraviolet curable resin or the like to a substrate for forming a hemispherical micro lens (optical lens) used for an optical communication device or the like, (10) a printing device that injects acid or alkali etching liquid for etching of a substrate or the like, and (11) a printing device that is provided with a liquid injecting head for ejecting a very small amount of other optional liquid drops.

Here, "ink drops" refer to a state of liquid ejected from a printing device, and include ones that trail in a grain shape, a tear shape, or a string shape. Also, it is sufficient for the "liquid" described here to be made of a material that can be injected by a printing device. For example, the "liquid" can be made of a material in a state of a liquid phase, including a material in a liquid state having high or low viscosity, and a material in a liquid state such as sol, gel water, an inorganic solvent, an organic solvent, a solution, liquid resin, or liquid metal (metal melt). The "liquid" also includes one in which particles of a functional material consisting of a solid material such as a pigment or metal particles are dissolved, dispersed, or mixed into a solvent, as well as liquid as a state of a material. Also, as a representative example of liquid, ink described in the above embodiments, liquid crystal, and the like can be listed. Here, ink includes common water-based ink, oil-based ink, and various kinds of liquid state compositions such as gel ink, hot melt ink, or the like.

What is claimed is:

1. A cartridge for storing liquid to be supplied to a printing device, the cartridge comprising:

a liquid chamber formed with an inner wall of a reservoir main body member and a flexible sheet member attached to the reservoir main body member;

a pressure receiving plate provided in the liquid chamber such that the surface thereof contacts the sheet member;

a first biasing member biasing the pressure receiving plate in a direction for enlarging an inner space of the liquid chamber;

a liquid supply port supplying liquid stored in the liquid chamber to the printing device;

an air introducing port introducing outer air to the inside of the liquid chamber;

a valve mechanism including a valve body and a second biasing member biasing the valve body in a direction for closing the air introducing port, the valve mechanism adjusting introduction of air to the liquid chamber by opening or closing the air introducing port; and a liquid detecting section provided inside the liquid chamber to optically detect liquid, wherein, when the cartridge is viewed in a direction perpendicular to a largest outer surface whose area is the largest among a plurality of outer surfaces of the cartridge in a state in which the cartridge is installed in the printing device, the air introducing port is provided in a position closer to an upper end of the largest outer surface relative to a center of the largest outer surface in a vertical direction and in a position closer to one end of a left end and a right end of the largest outer surface relative to a center of the largest outer surface in a horizontal direction, and the liquid detecting section is provided in a position closer to a lower end of the largest outer surface relative to the center of the largest outer surface in the vertical direction and in a position closer to the other end, that is opposite to the one end, of the largest outer surface relative to the center of the largest outer surface in the horizontal direction, and a projecting portion is provided in a position of a third wall facing the back surface of the pressure receiving plate among the inner wall close to the other end, and the projecting section serves as a rotation fulcrum of the pressure receiving plate when the back surface of the pressure receiving plate approaches the third wall, when the cartridge is viewed in the direction perpendicular to the largest outer surface in a state in which the cartridge is installed in the printing device.

2. A cartridge for storing liquid to be supplied to a printing device, the cartridge comprising:

a liquid chamber formed with an inner wall of a reservoir main body member and a flexible sheet member attached to the reservoir main body member;

a pressure receiving plate provided in the liquid chamber such that the surface thereof contacts the sheet member;

a first biasing member biasing the pressure receiving plate in a direction for enlarging an inner space of the liquid chamber;

a liquid supply port supplying liquid stored in the liquid chamber to the printing device;

an air introducing port introducing outer air to the inside of the liquid chamber;

a valve mechanism including a valve body and a second biasing member biasing the valve body in a direction for closing the air introducing port, the valve mechanism adjusting introduction of air to the liquid chamber by opening or closing the air introducing port; and a liquid detecting section provided inside the liquid chamber to optically detect liquid, wherein, when the cartridge is viewed in a direction perpendicular to a largest outer surface whose area is the largest among a plurality of outer surfaces of the cartridge in a state in which the cartridge is installed in the printing device, the air introducing port is provided in a position closer to an upper end of the largest outer surface relative to a center of the largest outer surface in a vertical direction and in a position closer to one end of a left end and a right end of the largest outer surface relative to a center of the largest outer surface in a horizontal direction, and the liquid detecting section is provided in a position closer to a lower end of the largest outer surface relative to the center of the largest outer surface in the vertical direction and in a position closer to the other end, that is opposite to the one end, of the largest outer surface relative to the center of the largest outer surface in the horizontal direction, the valve mechanism further comprises a lever member in which one end portion of the lever member adapted to contact with a back surface of the pressure receiving plate and the valve body is provided in the other end portion of the lever member, so that the air introducing port is opened or closed in accordance with movement of the lever member transmitted by motion of the pressure receiving plate, and the pressure receiving plate further comprises a rim projecting toward the back surface side of the pressure receiving plate, the rim is provided in an outer periphery of the pressure receiving plate at least other than a portion thereof that overlaps with the lever member when the cartridge is viewed in the direction perpendicular to the largest outer surface.

3. The cartridge according to claim 2, wherein, when the liquid chamber is viewed in the direction perpendicular to the largest outer surface in a state in which the cartridge is installed in the printing device, the inner wall comprises a first wall descending from a position below the air introducing port on a side of the one end of the liquid chamber toward the liquid detecting section, the first wall having an end point in a position in front of the liquid detecting section, a second wall descending from a position above the liquid detecting section on a side of the other end of the liquid chamber toward the liquid detecting section, the second wall having an end point in a position in front of the liquid detecting section, and a partition wall provided so as to cover other than the upper side of the liquid detecting section, and the liquid detecting section is provided below the end point of the first wall and the end point of the second wall.

4. The cartridge according to claim 3, wherein the end point of the second wall is located above the end point of the first wall when the cartridge is viewed in the direction perpendicular to the largest outer surface in a state in which the cartridge is installed in the printing device.

5. The cartridge according to claim 4, wherein a slope of a line connecting the end point of the first wall and the end point of the second wall is larger than the slope of the first wall, when the cartridge is viewed in the direction perpendicular to the largest outer surface in a state in which the cartridge is installed in the printing device.

6. The cartridge according to claim 2, wherein the rim is not provided in a part of a portion thereof facing the second wall.

7. A cartridge for storing liquid to be supplied to a printing device, the cartridge comprising:

a liquid chamber formed with an inner wall of a reservoir main body member and a flexible sheet member attached to the reservoir main body member;

a pressure receiving plate provided in the liquid chamber such that the surface thereof contacts the sheet member;

a first biasing member biasing the pressure receiving plate in a direction for enlarging an inner space of the liquid chamber;

a liquid supply port supplying liquid stored in the liquid chamber to the printing device;

an air introducing port introducing outer air to the inside of the liquid chamber;

a valve mechanism including a valve body and a second biasing member biasing the valve body in a direction for closing the air introducing port, the valve mechanism adjusting introduction of air to the liquid chamber by opening or closing the air introducing port; and a liquid detecting section provided inside the liquid chamber to optically detect liquid, wherein, when the cartridge is viewed in a direction perpendicular to a largest outer surface whose area is the largest among a plurality of outer surfaces of the cartridge in a state in which the cartridge is installed in the printing device, the air introducing port is provided in a position closer to an upper end of the largest outer surface relative to a center of the largest outer surface in a vertical direction and in a position closer to one end of a left end and a right end of the largest outer surface relative to a center of the largest outer surface in a horizontal direction, and the liquid detecting section is provided in a position closer to a lower end of the largest outer surface relative to the center of the largest outer surface in the vertical direction and in a position closer to the other end, that is opposite to the one end, of the largest outer surface relative to the center of the largest outer surface in the horizontal direction.

8. The cartridge according to claim 7, wherein the liquid detecting section is located below the inner wall of the reservoir main body member in a state in which the cartridge is installed in the printing device.

9. The cartridge according to claim 7, wherein the valve mechanism includes a lever member, the valve mechanism adjusting introduction of air to the liquid chamber by opening or closing the air introducing port with the lever member.

10. The cartridge according to claim 7, the cartridge further comprising:

an outer air introducing port introducing outer air from the outside of the cartridge to the inside of the cartridge, the air introducing port introducing the outer air, introduced from the outer air introducing port to the inside of the cartridge, to the liquid chamber.

11. The cartridge according to claim 7, wherein the reservoir main body member includes a first surface, a second surface facing the first surface, the flexible sheet member intersects the first surface and the second surface, the liquid supply port is formed on the second surface, and the air introducing port is located between the first surface and the second surface when the cartridge is viewed in a direction perpendicular to another direction from the first surface toward the second surface.

* * * * *